United States Patent [19]

Brieger

[11] Patent Number: 4,529,038

[45] Date of Patent: Jul. 16, 1985

[54] DIFFERENTIAL VENT AND BAR ACTUATED CIRCULATING VALVE AND METHOD

[75] Inventor: Emmet F. Brieger, Nogal, N. Mex.

[73] Assignee: GEO Vann, Inc., Houston, Tex.

[21] Appl. No.: 409,455

[22] Filed: Aug. 19, 1982

[51] Int. Cl.[3] ..... E21B 34/10

[52] U.S. Cl. ..... 166/312; 166/321

[58] Field of Search ..... 166/312, 311, 63, 297, 166/317-321, 332, 373; 137/861

[56] References Cited

U.S. PATENT DOCUMENTS

| | | | |
|---|---|---|---|
| 3,045,759 | 7/1962 | Garrett et al. | 166/320 |
| 3,527,297 | 9/1970 | Todd | 166/318 X |
| 3,662,834 | 5/1972 | Young | 166/374 |
| 4,299,287 | 11/1981 | Vann et al. | 166/297 |
| 4,324,293 | 4/1982 | Hushbeck | 166/317 |
| 4,330,039 | 5/1982 | Vann et al. | 166/297 |
| 4,434,854 | 3/1984 | Vann et al. | 166/386 |
| 4,436,155 | 3/1984 | Brieger | 166/297 |

*Primary Examiner*—Stephen J. Novosad
*Assistant Examiner*—Thuy M. Bui

[57] ABSTRACT

A tool for use downhole in a borehole for carrying out a backsurging method whereby existing open perforations are cleaned. The tool comprises an annular body having spaced cylindrical walls, each of which reciprocatingly receives spaced pistons which move individually relative to one another. A port is formed through each of the walls of each of the cylinders with the first port being normally closed by a first piston and the second port being normally open. The second piston is moved to close the second port. The tool is placed on the end of a tubing string or within a tool string and run downhole into the borehole. A packer device enables the pressure between the lower annulus, the upper annulus, and the tubing to be adjusted relative to one another. A bar is then dropped down the tubing string, contacts the second piston and moves the second piston to cover the second port. The tubing pressure is reduced to provide a pressure differential between the lower annulus and the interior of the tubing. The first valve automatically opens when a predetermined pressure differential is achieved between the tubing and lower annulus, thereby providing a predetermined pressure differential across the old perforations, and cleaning debris therefrom upon the opening of the first port.

30 Claims, 7 Drawing Figures

DIFFERENTIAL VENT AND BAR ACTUATED CIRCULATING VALVE AND METHOD

BACKGROUND OF THE INVENTION

After a borehole has been drilled into the ground, the casing cemented into place, and the formation completed so that production flows from the formation, up the tubing string, and to the surface of the ground, it is often desirable to backsurge the well in order to more thoroughly clean out some of the perforations, and unplug some perforations which may be clogged with debris. This operation is desirable in new completions which have been perforated, for example, with wireline casing guns, or on the other hand, it is often desirable to practice this backsurging technique on old producing wells that have been shut in or killed for some time, wherein the tubing often has been pulled and the well left dormant.

There are many occasions when a newly completed well does not produce at the rate anticipated by the logging engineer. Sometimes this lower production rate is due to some of the perforations being partially obscured or plugged.

In wells which have been produced for a considerable length of time, the perforations sometimes become plugged with accumulated debris or formation particles which have been translocated from the fluid-producing strata downstream towards the casing perforations.

It is also possible for the jet action of the shaped charges to form a densified wall or barrier between the perforations and the tunnels leading back up into the formation. In any event, proper backsurging techniques provide remedial action by which production rates can often be improved.

In order to properly backsurge a well, it is necessary to "shock" the payzone by the provision of a pressure differential suddenly effected between the perforations and the production tubing interior. A well which has been shut in at the surface until the bottom hole pressure increases to a suitable pressure, and then is open-flowed by opening the wellhead valve, will not provide proper backsurging for the reason that the volume of the production tubing acts to throttle or dampen the driving force across the perforations so that when the valve at the surface is suddenly opened, there is a relatively low change in flow rate which slowly increases to a maximum as the pressure differential from the perforations to the surface valve reaches equilibrium. This technique does not shock the well.

It is therefore desirable to backsurge a well with the control valve being located as close as possible to the perforations. This process provides a differential pressure between the tubing string and formation so as to cause a sudden flow through the perforations from the formation which is of a sufficient magnitude to translocate the debris in the tunnels and perforations into the tubing string, where the debris is produced along with the well fluids.

U.S. Pat. No. 3,662,834 to Young discloses a method and apparatus for cleaning previously perforated wells which are to be later fractured, acidized, or otherwise treated. The apparatus includes a valve series connected in the tubing string, with an elongated sleeve slidably mounted around the valve to open and enclose ports extending therethrough. Pressure is effected through the tubing string to move the sleeve downwardly and align ports to permit wellbore fluids from the formation to flow into the tubing string. A barrier is mounted within the valve to form a lower chamber which is preferably at atmospheric pressure whereby upon opening the valve, a sudden high pressure differential is developed between the connate fluids in the formation and the closed chamber. This sudden pressure differential across the perforated wellbore interval induces a rapid, high-velocity flow of connate fluids from the formation, through the perforations, and into the closed chamber. These rushing fluids wash out the debris, along with any loose formation materials, from the perforations. Once this sudden flow ceases upon the filling of the chamber, and preferably the loose materials are given time to settle into the lower portion of the chamber, the barrier is removed to permit the injection of fluid into the perforations for treating the well. The principle disadvantage is the pressurizing of the tubing string to a pressure greater than the formation pressure, i.e. overbalance, to actuate the valve, whereby the backsurge ceases upon the closed chamber being filled.

Apparatus and method for achieving the above-desired well techniques is the subject of the present invention.

SUMMARY OF THE INVENTION

This invention comprehends both method and apparatus for backsurging a downhole formation of a wellbore. The apparatus of the present invention comprehends a downhole tool connected into a tubing string along with a packer device, so that the tool in combination with the production string and packer provides a lower and upper annulus. The tool of the present invention includes a body having a longitudinal axial passageway formed therethrough and in communication with the passageway of the production tubing. The interior of the tool is provided with two spaced working chambers, each of which reciprocatingly receives an annular piston in spaced relationship therewithin, and each of which is provided with a lateral flow port through the wall thereof.

One of the ports is normally closed by the piston and is held into the closed position by a shear pin. A power chamber is further included by which a pressure differential effected between the lower annulus and the interior of the tool forces the piston to move from the closed to the open position relative to the port associated therewith, thereby providing a vent, or lateral flow passageway, through which flow from the lower annulus can proceed into the tool, up the tubing string, and to the surface of the ground.

The other working chamber reciprocatingly receives the other annular piston therein. The second piston is held in the open position relative to the second port by a shear pin. The second port is formed through both the second piston and the cylinder wall in aligned relationship with one another so that the port is normally releasably held in the open position. An enlargement formed on the piston projects into the axial passageway and is adapted to engage a special traveling bar so that when the bar is arrested by the piston enlargement, the pin shears and the piston moves from the open to the closed position.

The above apparatus enables the method of the present invention to be practiced, which includes the steps of dividing the borehole into an upper and lower annulus by interposing a packer device within the tubing string, and preferably in close proximity to the perforations to be treated. The open port provides a passageway which extends from the surface of the ground down into the lower annular chamber. Pressure is effected within the tubing string at the surface of the ground and is also effected within the lower annulus, thereby adjusting the lower annular pressure to the desired value. An opening bar is dropped down the tubing string, falls therethrough, and into the tool where the bar strikes the piston enlargement, thereby moving the piston to the closed position. This action isolates the lower annulus, so pressure within the tubing string is next released at the surface to achieve a predetermined driving force or pressure differential between the lower annulus and the interior of the tubing string. This driving force is also placed across the pressure-actuated piston, biasing the piston towards the open position relative to the port therefor.

The shear pin of the hydraulically actuated piston is selected to fail and allow the piston to move to the open position at a predetermined differential thereacross. The driving force effected on one side of the piston is also the pressure exerted on the formation near the perforations, and consequently, when the pin shears, and the piston moves to the open position, there is a backsurge across the perforations of the casing which cleans debris from the tunnels leading back up into the formation, and the perforations. This action enhances the production rate of the downhole formation.

Accordingly, a primary object of the present invention is the provision of method and apparatus for backsurging the perforations of a wellbore such as existing open perforations in killed wells or producing wells that were killed and the tubing pulled.

A further object of the present invention is the provision of a tool in combination with a tubing string and packer for use downhole in a borehole for cleaning perforations.

A still further object of this invention is the provision of a method of sequentially backsurging and perforating a wellbore, wherein old perforations of a completed formation located downhole in a borehole are backsurged and thereafter another group of perforations are formed in the casing.

Another and still further object of the present invention is the provision of a method and apparatus for enhancing production of an old well by forcing a predetermined pressure drop to occur across the perforated portion of the casing.

An additional object of this invention is the provision of a method and apparatus by which a predetermined pressure differential is effected between a lower borehole annulus and the interior of the tubing string, so that a lower formation can be backsurged and cleaned to enhance production, and thereafter, another part of the casing can be perforated, and thereafter, production through both groups of perforations can occur into the tubing string.

A further object of this invention is the provision of a method of sequentially backsurging old perforations of a wellbore followed by the formation of new perforations in the same casing.

A still further object of this invention is the provision of a well completion technique wherein an old perforated zone is backsurged and immediately thereafter a new perforated zone is formed in the wellbore.

These and various other objects and advantages of the invention will become readily apparent to those skilled in the art upon reading the following detailed description and claims and by referring to the accompanying drawings.

BRIEF DESCRIPTION OF THE DRAWINGS

For a detailed description of a preferred embodiment of the invention, reference will now be made to the accompanying drawings wherein.

DETAILED DESCRIPTION OF THE PREFERRED EMBODIMENT

Figure 1:
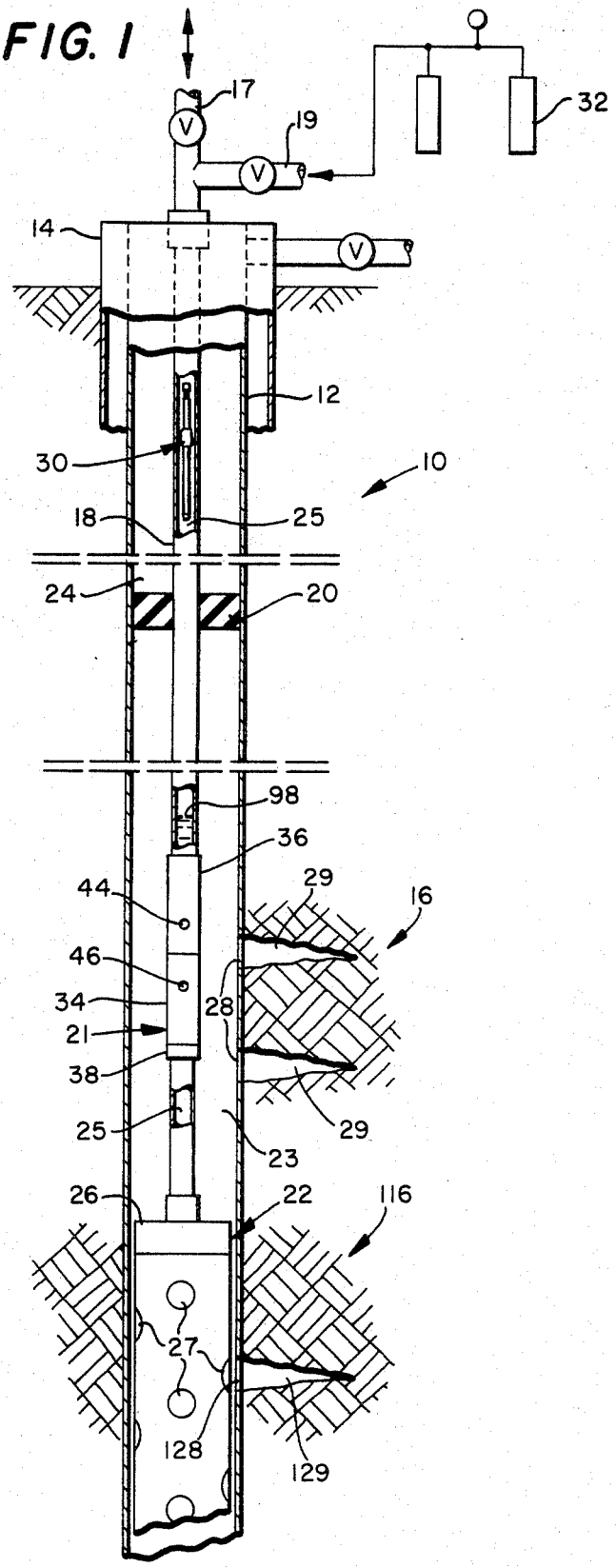
FIG. 1 is a part diagrammatical, part schematical illustration of a cross-sectional view of the earth, with there being a borehole formed therein, with apparatus made in accordance with the present invention being associated therewith.
Figure 2:
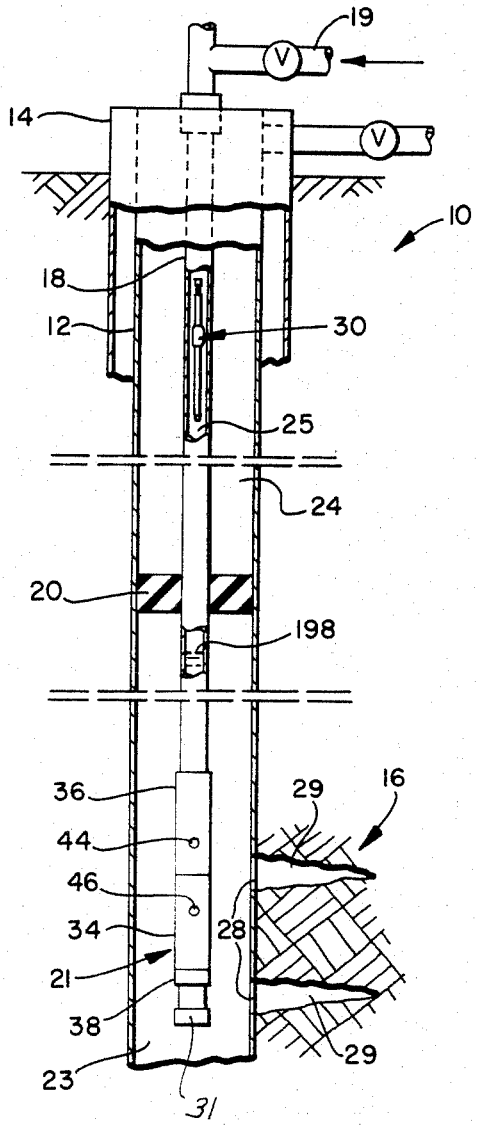
FIG. 2 is a schematical illustration which sets forth another embodiment of the invention.

FIGS. 1 and 2 of the drawings schematically disclose a wellbore 10 illustrating two typical environments for the method apparatus made in accordance with the present invention. Referring initially to FIG. 1 where additional perforations are to be made in the well, the wellbore 10 is cased by a casing diagrammatically illustrated by numeral 12, and includes a wellhead 14 of conventional design at the upper extremity thereof. The casing 12 extends downhole within the earth and penetrates an old and previously completed payzone 16 and a new formation 116, which usually will be hydrocarbon-producing formations. A lubricator 17 is located at the upper end of a tubing string 18. A lateral pipe 19 leads from the tubing string, and both the lubricator and lateral pipe include the illustrated valves located therein.

A packer device 20, which can take on a number of different forms, is attached to a medial portion of the tubing string 18. The packer 20 can be a permanent or a production packer. A tool, or circulation valve 21, made in accordance with the present invention, is series connected in tubing string 18 below the packer 20.

In the embodiment of the invention disclosed in FIG. 1, the combination includes a perforating gun 22, which can take on several different forms, but preferably is made in accordance with R. R. Vann's U.S. Pat. Nos. 3,706,344 and 4,140,188.

The tool string, that is, the tubing 18, packer 20, circulation valve 21, and generally a gun 22, forms a casing annulus, and the packer 20 divides the annulus into a lower annulus 23 and an upper annulus 24. The interior axial passageway 25 of the tubing 18 extends from the lubricator 17 down through the circulation valve 21, and down to the jet perforating gun 22. The jet perforating gun 22 includes a gun firing head 26, the details of which are more fully set forth in the before-mentioned patents. The gun 22 includes a plurality of shaped charges 27 of conventional design, which are detonated to form perforations 128, and tunnels 129, which extend back up into the new formation 116.

The old perforations 28 with tunnels 29 in old formation 16 are shown located uphole of the new perforations 128 and tunnels 129 in new formation 116. The tunnels 29, 129 extend radially away from the wellbore and out into the formations 16, 116.

A traveling bar 30 is of a size to be dropped through the lubricator 17, and is free to fall down through the tubing axial passageway 25 until the bar strikes the interior components of the tool 21, as will be more fully described later on in this disclosure.

Referring now to FIG. 2 where no new peforations are to be made but the old perforations are to be back-surged, circulation valve 21 is connected to the lower end of the tubing string 18 without a perforating gun as shown and described with respect to FIG. 1. Valve 21 is positioned in proximity of the previously completed zone 16. The casing 12 had previously been perforated at 28, and the perforations 28 are connected to tunnels 29 leading radially away from the casing 12 and back up into the formation 16. Cap 31 forms a closure member at the lower extremity of valve 21, and therefore also forms the lowermost member of the string.

Figure 3:
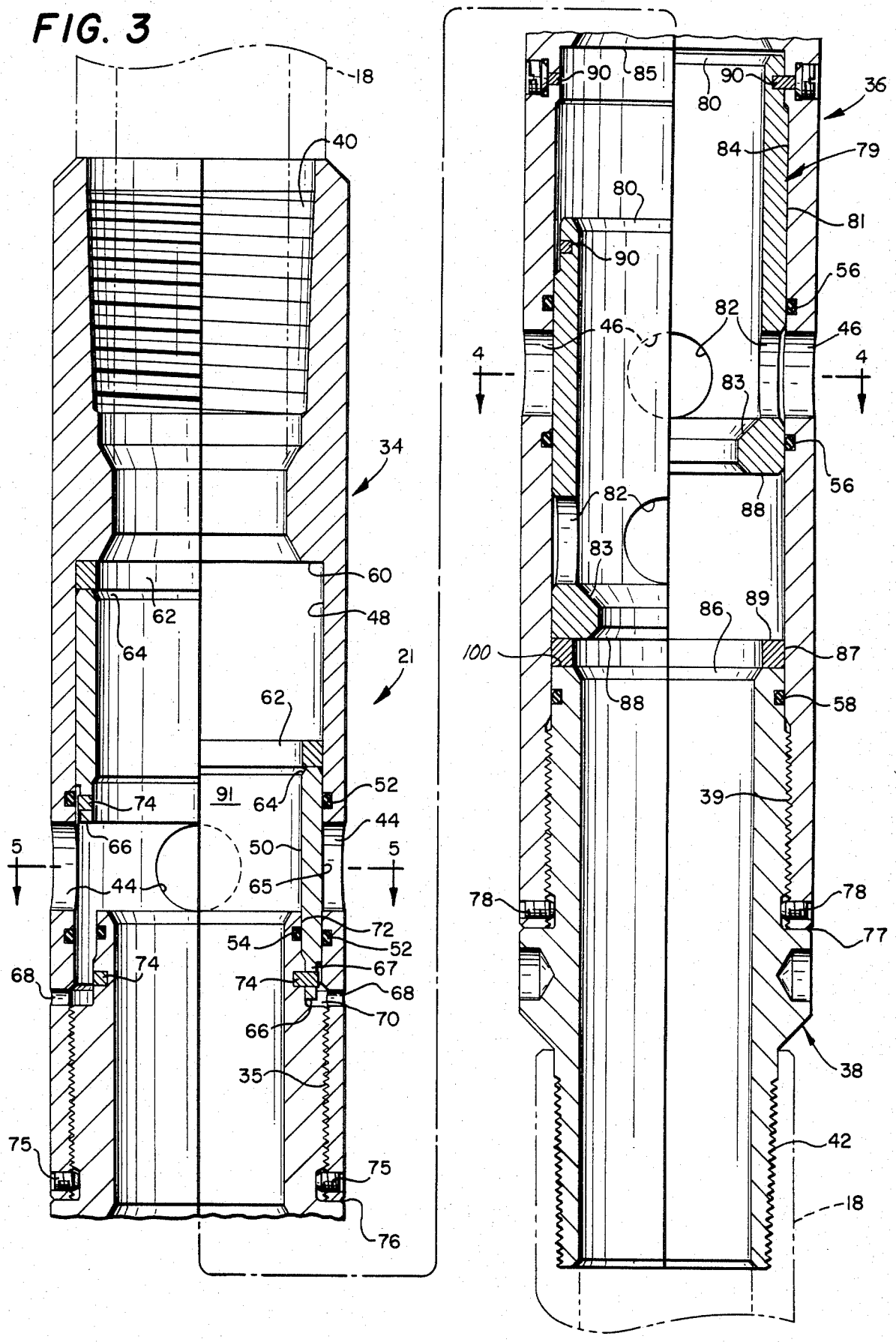
FIG. 3 is an enlarged, cross-sectional view of part of the apparatus disclosed in FIGS. 1 and 2.
Figure 4:
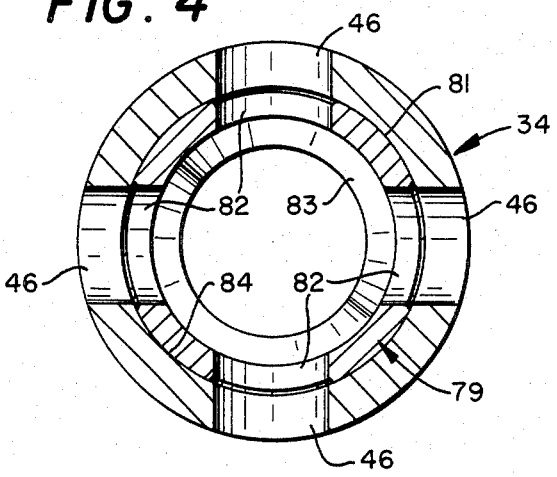
FIG. 4 is a cross-sectional view taken along line 4—4 of FIG. 3.
Figure 5:
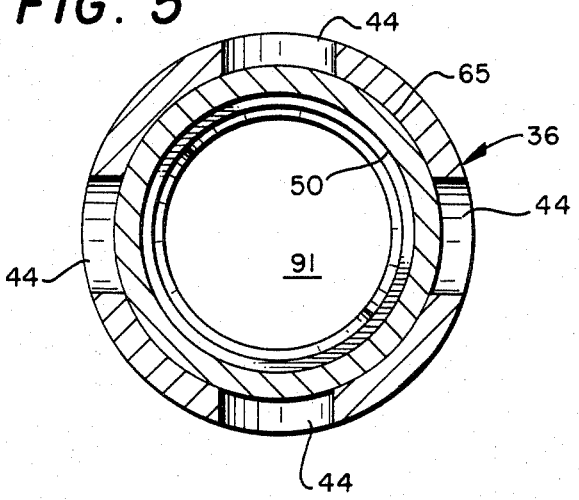
FIG. 5 is a cross-sectional view taken along line 5—5 of FIG. 3.

FIG. 3 discloses the details of the differential pressure-actuated vent and bar actuated circulating valve 21 shown in FIGS. 1 and 2. As seen in FIG. 3, the circulating valve 21 is comprised of a plurality of coacting parts which include a main body comprised of members 34, 36, and 38. Central member 36 is provided with threads 35 which threadedly engages upper member 34. The upper member 34 forms the upper end of the main body. Threads 39 threadedly affix the lower member 38 in a removable manner to central member 36. Accordingly, the upper member 34 forms a threaded box end 40 of the valve while the lower member forms a threaded pin end 42 of the valve, also referred to in the oil patch as "the box end and the pin end" of the tool. The opposed box and pin ends enable the valve 21 to be connected into various different standard tool joints in a convenient manner.

Upper vent ports 44 are formed through the upper member 34 in spaced relationship relative to lower vent ports 46 in central member 36. The lower vent ports 46 are formed through a wall surface of the central member 36. The interior cylindrical surface 48 of upper member 34 is formed in the port area and reciprocatingly receives an upper annular piston 50 in a slidable manner therewithin. Spaced O-rings 52 are placed above and below port 44 and seal the external surface 55 of the piston 50 and surface 48 of member 34. An opposed O-ring 54 mounted in the external upper end of member 36 seals between interior surface 65 of piston 50 and the external surface of member 36. Thus ports 44 are sealed from fluid flow therethrough.

Spaced O-rings 56 are positioned above and below lower ports 46 and seal the interface between the external surface 81 of the lower piston 79 and the internal surface of member 36, while O-ring 58 housed in the external surface of the upper end of member 38 provides a seal between the lower member 38 and the internal surface of central member 36.

A circumferentially extending shoulder 60 forms a stop at the upper terminal end of the upper member 34. An annular ring 62 is interposed between the upper terminal end 64 of the upper piston 50 and the shoulder 60 and forms a cushion therebetween. The outer peripheral surface 65 of the upper piston 50 slidably engages the interior surface 48 of upper member 34 in close tolerance relationship therewith.

Numeral 66 indicates the lower edge portion of the upper piston 50, which is reduced in thickness at 67 thereof so that both the outside diameter and the inside diameter thereof are slightly spaced from surface 48 of member 34 and the outer surface 72 of central member 36. Power chamber 70 is connected to the lower annulus 23 of the borehole 10 by means of one or more of the illustrated weepholes 68. The upper marginal outer surface area 72 of member 36 together with the cylinder formed by surface 48 form the before-mentioned power chamber 70. A shear pin 74 maintains the upper piston 50 in the illustrated closed position until a suitable force is effected within the power chamber 70 which is of a magnitude to shear the pin 74. A lock bolt 75 prevents relative rotation between the upper and central members 34, 36. Numeral 76 indicates the interface formed between the upper and central members 34 and 36. Numeral 77 similarly indicates the interface formed between central member 36 and the lower member 38. Lock bolt 78 maintains members 36 and 38 in the proper connection relative to one another.

Lower piston 79 is reciprocatingly received within a lower working chamber 84 and includes an upper circumferentially extending edge portion 80, an outer peripheral wall surface 81, and at least one, but preferably a plurality, of ports 82. The ports 82 are radially spaced from one another and formed through the wall 81 thereof, in aligned relationship relative to the before-mentioned ports 46. The piston 79 inwardly enlarges at the lower inside marginal end portion thereof, thereby forming an inwardly directed shoulder 83 which reduces the axial passageway formed through the piston 79 to a value which is approximately equal to the nominal inside diameter of the tubing 18. Cylindrical working chamber 84 reciprocatingly receives the piston 79 in a slidable manner therewithin. The upper end of the chamber 84 terminates in the illustrated shoulder 85.

Upper edge 86 of the lower member 38 provides a circumferentially extending shoulder 100 against which there is received a brass annular cushion member 87. The lower side 88 of the enlarged shoulder 83 of the piston 79 abuttingly engages upper face 89 of the brass member 87.

Shear pin 90 extends through an aperture formed in member 36 and into a blind hole formed in the piston sidewall 81. The shear pin 90 captures the piston 79 relative to the working chamber 84 thereof. Numeral 91 broadly indicates the longitudinally extending axial passageway of the valve 21. The axial passageway 91 preferably has a minimum inside diameter equal to the nominal inside diameter of the tubing 18.

Figure 7:
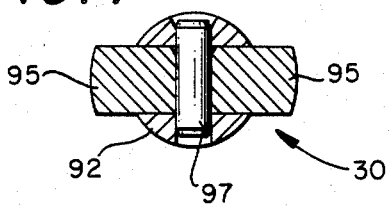
FIG. 7 is a cross-sectional view taken along line 7—7 of FIG. 6.
Figure 6:
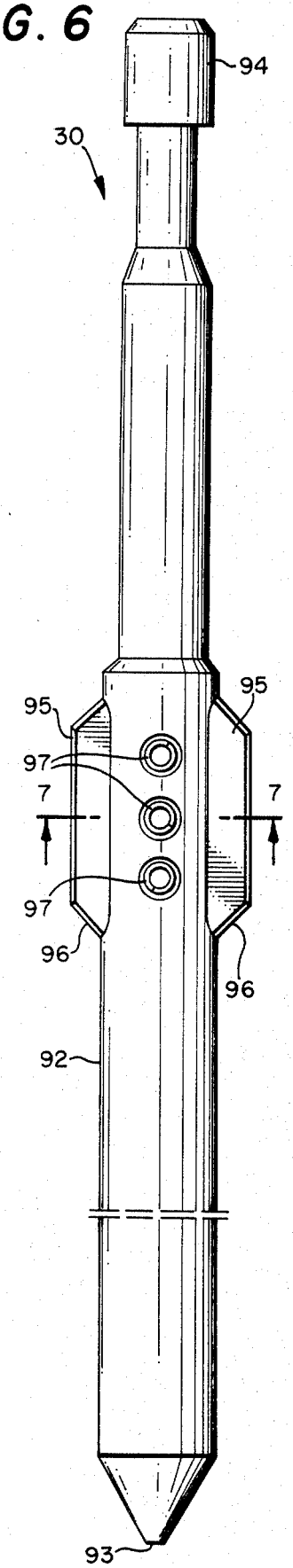
FIG. 6 is an enlarged, elevational view of the bar disclosed in FIGS. 1 and 2.

In FIGS. 6 and 7, the traveling bar 30 is seen to be of a size to be freely received down through the entire axial passageway of the tool string of the present invention. The traveling bar 30 includes a main body 92 having a lower end 93, and a fishing neck 94 located at the upper opposed end thereof. A pair of radial fins 95 are rigidly secured to the body 92 and present a massive leading edge 96 which impacts against the enlargement or shoulder 83 of the second or lower piston 79. The leading edge 96 is contoured in a complementary manner relative to the conical shaped, seat-like face formed on the enlargement 83. Pins 97 secure the fins 95 within the main body 92.

In FIG. 1, numeral 98 broadly indicates the fluid level within the tubing string 18. The fluid level can be at different locations, as noted at 198 of FIG. 2, which will be appreciated by those skilled in the art.

Referring now to the wellbore environment shown in FIG. 1, there is illustrated perforated formation 16, which had been previously perforated to create perforations 28 and associated tunnels 29. Also shown is another or unperforated formation 116, which had not been previously perforated and is illustrated with new perforations 128 and associated tunnels 129 pursuant to the present invention. Various methods may be used to complete this well, depending upon whether it is desirable to backsurge the original perforations 28 and new perforations 128 at the same time, or to first backsurge the original perforations 28 and then perforate and backsurge the new perforations 128. Although two different payzones 16, 116, i.e. an upper and a lower formation, are shown in FIG. 1, the present invention is equally applicable where only one formation is involved. In such a case the original perforations can be backsurged and new additional perforations can be made in the same formation.

In the case where it is desirable to first backsurge the original perforations 28 and then later perforate and backsurge the new perforations 128 as illustrated in FIG. 1, the assembly is attached to production tubing string 18 and the tool string is lowered into the borehole 10 with circulation valve 21 in the open position. Thus, drilling fluids in the borehole 10 are permitted to flow through ports 46 and into the axial passageway 25 of tubing string 18. Safety is enhanced by permitting the tubing string 18 to be opened to the flow of drilling fluids. If the tubing string were to be closed and the tubing empty, i.e. without fluids therein, and the tubing string accidentally opened to the flow of drilling fluids, the hydrostatic head in the annulus would drop as the drilling fluids passed into the interior of the tubing string, whereby the hydrostatic head in the annulus would no longer be sufficient to kill the well and the well might blow out. By keeping valve 21 open as tubing string 18 is lowered into the borehole 10, the hydrostatic head would be maintained on formation 16 to keep the well controlled and killed.

Once packer 20, valve 21, and perforating gun 22 are positioned at the appropriate depth, clean fluid is circulated down the tubing string 18, causing the drilling fluids to flow through valve 21 at lower ports 46 and into the annulus. The fluid column 98 within tubing string 18 is lowered to the desired level with nitrogen. Once the desired level of fluid column 98 is achieved, packer 20 is set. Packer 20 may be either a retrievable packer or a permanent packer. If a permanent packer, a seal is stabbed into the seat of the packer and the wellhead is flanged up. At this stage, the pressure differential between the lower annulus 23 and the axial passageway 25 of tubing string 18 is equalized because of open ports 46 in valve 21.

The closing bar 30, shown in FIG. 6, is dropped through lubricator 17. As traveling bar 30 contacts lower piston 79, contoured edge portion 96 engages the similarly contoured edge portion formed on enlargement 83, thereby spreading the force of the impact of bar 30 over a relatively large area. Traveling bar 30 then carries piston 79 downhole until face 88 of the enlargement 83 abuttingly engages face 89 of brass member 87, thereby arresting the downward travel of piston 79 and decelerating piston 79 sufficiently to prevent permanent deformation of the coacting parts. The distance measured between faces 88 and 89 is of a length sufficient to properly position an ample area of surface 81 of piston 79 for sealing engagement with the spaced seals 56 located on either side of lateral flow ports 46. Bar 30 stops in its downward travel with the arresting of the downward movement of piston 79. After piston 79 moves to its lowermost position, ports 46 are closed, thereby isolating the lower borehole annulus 23 and making it possible to reduce the pressure in the interior 25 of tubing string 18 to a desired value.

Shear pins 74 holding upper piston 50 in the closed position are set to shear at a predetermined pressure differential between the axial passageway 25 of tubing string 18 and the lower borehole annulus 23. The number of shear pins 74 is dependent upon the predetermined pressure differential desired for the opening of valve 21. Each shear pin 74 is set to shear at 1,000 psi with the exception of one shear pin 74 which will shear at 500 psi. Thus, depending upon the sizing and number of shear pins 74, upper piston 50 may be opened at 500 psi increments ranging from 500 psi to 4,000 psi or more.

To reach the desired pressure differential to shear pins 74, the nitrogen within the axial passageway 25 of tubing string 18 is reduced by bleeding the nitrogen off either through lubricator 17 or lateral valve 19. Upon the bleeding of the nitrogen, the hydrostatic head within tubing string 18 is reduced until the tubing string pressure is at some value less than the formation pressure but not less than the preset opening differential pressure for valve 21; that is, the pressure differential is of a value below the pressure differential required to shear pins 74 of upper piston 50. The well is shut in, and if the surface pressure does not increase, it is known that the circulating valve 21 has been properly closed by bar 30.

The pressure within tubing string 18 is again slowly reduced by bleeding off nitrogen until the pressure differential across piston 50 reaches the predetermined pressure differential required to shear pins 74 and open valve 21. The additional annulus pressure in power chamber 70 acts on the bottom of upper piston 50 to force piston 50 uphole within upper member 34, thereby shearing pins 74 and backsurging original perforations 28.

As piston 50 is forced to move uphole, brass member 62 also concurrently moves uphole so that with extremely high pressure differentials, brass member 62 abuts shoulder 60, while the upper edge 64 of piston 50 abuts the lower shoulder of brass member 62, thereby deforming brass member 62 and decelerating piston 50 sufficiently to avoid permanent deformation of the coacting parts. When the shear pins 74 are initially sheared, and piston 50 is thereby released, there is a tremendous force available at power chamber 70 for accelerating piston 50 and ring 62 uphole. In order to reduce the maximum velocity of piston 50, the lower marginal edge of piston skirt 67 is reduced on either side thereof; accordingly, as soon as the inner and outer surfaces of the reduced edge portion 67 clear the spaced pair of O-rings 52, fluid commences to leak from chamber 70 across skirt 67, thereby limiting the velocity of piston 50.

After the valve 21 is opened and the original perforations 28 backsurged and after evaluating production from the cleaned existing perforations 28, new payzone 116 may be perforated. Further, it can easily be seen that the present invention may be used to reperforate the original perforated formation 16, the original perforations 28 having been cleaned.

In order to perforate unperforated formation 116, the present method includes the attachment of perforating gun 22 to the lower end of tubing string 18 as shown in FIG. 1. Assuming that perforation of formation 116 is still desirable after evaluating production from the newly backsurged perforations 28 and tunnels 29 of formation 16, the well is shut in and closing bar 30 is fished out of tubing string 18 through lubricator 17 and removed from borehole 10. Thereafter, a standard firing bar, such as described in the above-identified patent applications, is dropped down through tubing string 18. This standard bar is of a size sufficient to pass through enlargement 83 of lower piston 79 and to continue on downhole to impact with firing head 26 of jet perforating gun 22. Formation 116 is perforated without backsurging.

In the case where it is desirable to simultaneously backsurge the original perforations 28 and tunnels 29 of perforated formation 16, along with the new perforations 128 and tunnels 129 of unperforated formation 116, the tool string is run into the borehole with the ports 46 of valve 21 in the open position as shown in FIG. 1. Clean fluid and the nitrogen is circulated down tubing string 18 to force the fluid level 98 to a desired level by passing excess drilling fluids through ports 46 and into the annulus of borehole 10. Once the desired fluid level 98 is reached, packer 20 is set. A standard bar of a size sufficient to pass through enlargement 83 is dropped downhole to detonate perforating gun 22. The closing bar 30 is then dropped down through tubing string 18 to engage piston 79 and close ports 46. The nitrogen is then bled off to reduce the hydrostatic head in tubing string 18 until the desired pressure differential is reached. Once it is determined that the valve has in fact closed, nitrogen is further bled off to reach the pressure differential at which shear pins 74 will shear, permitting upper piston 50 to move upwardly and open ports 44. Upon the opening of ports 44, both original perforations 28 and tunnels 29 and new perforations 128 and tunnels 129 will be backsurged and cleaned.

Referring now to FIG. 2, there is illustrated an environment where old perforations 28 and tunnels 29 are to be backsurged and no new perforations are to be made. In such a situation, the tool string is assembled as shown in FIG. 2 and no perforating gun is suspended from the tubing string 18. The lower end of circulation valve 21 is closed by cap or plug 31. The tool string is again lowered into the well with valve 21 in the open position, thereby permitting the influx of drilling fluids into tubing string 18. The well can be acidized and/or produced through open ports 46 prior to backsurging. For backsurging, clean fluid and then nitrogen is circulated into the tubing string 18 to lower the fluid column 198 to the desired level. Packer 20 is then set and the nitrogen is bled off. Once the nitrogen reduces the differential pressure between the axial passageway 25 of tubing string 18 and lower borehole annulus 23 to the desired level, shear pins 74 will shear and open valve 21 to thereby backsurge perforations 28 and tunnels 29. The well is then cleaned by flow through ports 44 and lateral flow pipe 19.

While a preferred embodiment of the invention has been shown and described, modifications thereof can be made by one skilled in the art without departing from the spirit of the invention.

I claim:

1. A valve suspended on a pipe string into a cased borehole with an open axial passageway extending from the valve to the surface for the flow of fluids, comprising:

a tubular body series connected in the tubing string and having a portion of the axial passageway extending therethrough;

ports through said body;

a first member slidably disposed on said body between an open position opening said ports to fluid flow between the axial passageway and the borehole and a closed position for closing said ports to fluid flow;

a first portion of the first member being exposed to fluid pressure in the axial passageway such that said fluid pressure in the axial passageway tends to move the first member to the closed position and a second portion of the first member being exposed to borehole pressure such that the borehole pressure tends to move the first member to the open position opening said ports;

apertures through said body spaced apart from said ports; and a second member slidably disposed on the body between an open position opening the apertures to fluid flow between the axial passageway and the borehole and a closed position closing the apertures to fluid flow.

2. A valve series connected in a tubing string suspended in a cased borehole, the tubing string forming an open passageway from the surface to the valve, comprising:

a tubular body having a portion of the open passageway extending therethrough and first and second ports through the tubular wall of said body and extending to said open passageway;

a piston slidably received on said body and closing said first port;

a member slidably received on said body and opening said second port in the absence of a stimulus tending to slide said member to close said second port;

first means for hydraulically sliding said piston on said body to open said first port; and second means for applying the stimulus to said member on said body to close said second port.

3. The valve of claim 2 wherein said member includes an annular projection into the axial passageway for engagement with said second means upon sliding said member to close said second port.

4. The valve of claim 2 and including shock absorber means for cushioning the sliding movement of said piston and said member on said body.

5. The valve of claim 2 and including seal means straddling said first and second ports for sealingly engaging said piston and said member, respectively.

6. The valve of claim 2 wherein said first means includes a chamber formed by said tubular body and communicating with the cased borehole.

7. The valve of claim 6 wherein said first means includes holes through said tubular body communicating with said chamber and cased borehole.

8. The valve of claim 2 and including means releasably holding said piston and said member relative to said first and second ports.

9. The valve of claim 2 wherein said member includes ports registering with said second ports in the open position and nonregistering upon said member sliding to the closed position.

10. In a cased borehole which extends downhole through a formation to be completed, wherein a tubing string forms a passageway from proximity of the formation to the surface of the ground, with there being a packer device located in the tubing string, the improvement comprising:

a backsurging tool connected in series relationship within the tubing string and positioned below the packer, said tool including an annular body having first and second ports spaced from another, said first port being normally open and said second port being normally closed; spaced first and second cylinder surfaces formed along a longitudinal marginal length of the interior of the body at said spaced first and second ports;

a first piston and a second piston, respectively, sealingly received in a slidable manner relative to said first and second cylindrical surfaces; said first piston normally uncovering said first port, means by which said first piston can be forced to move within said first cylinder and close said first port to prevent flow therethrough, thereby isolating the tubing interior from the casing annulus;

said second piston normally covering said second port to prevent flow therethrough; means by which a pressure differential effected between the exterior and the interior of the body causes said second piston to reciprocate from the closed to the open position;

whereby the pressure within the tubing string can be reduced to a value which is below the pressure measured within the annulus to thereby move said second piston to open said second port.

11. The improvement of claim 10 wherein said second piston is normally closed and is hydraulically moved to the open position while said first piston is normally open and is moved to the closed position by impacting said first piston with a mass run down the interior of the tubing string and into abutting engagement with said first piston.

12. The improvement of claim 11 wherein said first and second pistons have an axial passageway formed therethrough, said first piston having a boss formed on the interior thereof for engaging said mass and thereby being moved downhole into the recited open position.

13. The improvement of claim 12 wherein said mass is an elongated member having an outwardly directed member formed thereon for engaging said boss; stop means located below said first piston for arresting said first piston and said mass.

14. The improvement of claim 10 wherein a jet firing gun is located below said tool, said gun having a gun firing head connected to discharge said gun when said head is actuated; said gun firing head being in communication with the interior of said tool so that a gun firing device can be run downhole into engagement with said gun firing head;

whereby said tool can be actuated to clean the perforations from the one set of perforations, and thereafter the gun can be detonated to form a second set of perforations.

15. The improvement of claim 14 wherein said second piston is normally closed and is hydraulically moved to the open position while said first piston is normally open and is moved to the closed position by impacting said first piston with a mass run down the interior of the tubing string and into abutting engagement with said first piston.

16. The improvement of claim 15 wherein said first and second pistons have an axial passageway formed therethrough, said first piston having a boss formed on the interior thereof for engaging said mass and thereby being moved downhole into the recited open position.

17. The improvement of claim 16 wherein said mass is an elongated member having an outwardly directed member formed thereon for engaging said boss; stop means located below said first piston for arresting said first piston and said mass.

18. The improvement of claim 17 wherein said second piston reciprocates within said second cylinder, said second cylinder having one end connected to have tubing pressure effected thereon; said second cylinder being connected to have annulus pressure effected on the other end thereof to thereby force said second piston to reciprocate within said second cylinder.

19. The improvement of claim 10 wherein said second piston reciprocates within said second cylinder, said second cylinder having one end connected to have tubing pressure effected thereon; said second cylinder being connected to have annulus pressure effected on the other end thereof to thereby force said second piston to reciprocate within said second cylinder.

20. The improvement of claim 19 wherein a jet firing gun is located below said tool, said gun having a gun firing head connected to discharge the said jet firing gun when said head is actuated; said gun firing head being in communication with the interior of said tool so that a gun firing device can be run downhole into engagement with said gun firing head;

whereby said tool can be actuated to clean the perforations from the one set of perforations, and thereafter said gun can be detonated to form a second set of perforations.

21. In a well having a wellbore which extends from the surface downhole to a payzone, said well including a casing which separates a hydrocarbon-producing formation from the interior thereof, perforations connecting the formation to the casing interior, and a tubing string extending from the surface downhole into the wellbore, a packer device connected to a medial part of the tubing string which divides the borehole annulus into an upper and lower annular area, the combination with said well of a differential vent and bar actuated circulating valve;

said valve is located in said tubing string at a location below said packer, said valve including an outer body having an axial passageway formed therethrough, first and second cylinders formed within said axial passageway;

first and second pistons reciprocatingly received in slidable sealed relationship, respectively, within said first and second cylinders, respectively;

a first vent port formed through the sidewall of said first cylinder; said first piston, when reciprocated into one position of operation, covers said first vent port and precludes flow therethrough; means responsive to pressure effected between the lower annulus and the interior of the tubing string for reciprocating said first piston into an alternate position which uncovers said first port and permits flow therethrough;

a second vent port formed through the sidewall of said second cylinder; said second piston, when reciprocated into one position of operation, provides for flow through said second port, and when reciprocated into an alternate position, precludes flow therethrough;

means connected to said second piston by which said second piston is reciprocated to a position which moves said second port from an open into a closed configuration;

whereby said tubing string can be run into the wellbore with the second vent port open and the first vent port closed, the packer set, and thereafter pressure can be applied to the tubing interior from the surface of the ground, and then the second port can be closed, whereupon the tubing pressure can thereafter be reduced until said first port is forced to move to the open position, thereby causing a driving force to be effected across the perforations to thereby clean up the perforations and enhance the production of the formation.

22. The combination of claim 21 wherein said first piston is normally closed and is hydraulically moved to the open position while said second piston is normally open and is moved to the closed position by impacting said second piston with a mass run down the interior of the tubing string and into abutting engagement with said second piston.

23. The combination of claim 21 wherein said first and second pistons have an axial passageway formed therethrough, said second piston having a boss formed on the interior thereof for engaging said mass and thereby being moved downhole into the recited open position.

24. The combination of claim 21 wherein said mass is an elongated member having an outwardly directed member formed thereon for engaging said boss; stop means located below said second piston for arresting said second piston and said mass.

25. The combination of claim 22 wherein a perforating gun is affixed to the lower end of the tubing in underlying relationship respective to said valve, and said mass is removed from said second piston and another mass run downhole to fire said gun.

26. The combination of claim 25 wherein said perforating gun includes a gun firing head which is impacted with another said mass in order to detonate said gun.

27. Method of backsurging the perforations of a hydrocarbon-containing formation located downhole in a borehole which has been cased and perforated comprising the steps of:

(1) forming a flow passageway from the surface of the ground, down through the tubing string, and into the lower annulus; and thereafter (2) isolating the tubing string interior from the lower annulus; and thereafter (3) reducing the pressure within the tubing string to a value less than the pressure in the lower annulus; and thereafter (4) forming another flow path from the annulus, into the tubing string, and to the surface of the ground, thereby causing a surge of flow to occur from the formation, across the perforations, into the tubing string, and up to the surface of the ground.

28. The method of claim 27 and further including the steps of moving a mass downhole through the interior of the tubing string in order to carry out the above step (2).

29. A method of backsurging perforations in a formation located downhole in a cased borehole, a valve series connected in a tubing string with a packer to be suspended in the borehole, comprising the steps of:

(1) providing the valve with a tubular body having first ports closed by a first piston and second ports opened by a second piston;

(2) lowering the tubing string into the cased borehole with the second ports open to the flow of well fluids into the tubing string;

(3) circulating clean fluids and then nitrogen down the tubing string to circulate the well fluids through the second ports and into the borehole until the clean fluids reach a desired level in the tubing string;

(4) setting the packer to close off the lower annulus of the borehole;

(5) dropping a bar through the tubing string to engage and slide the second piston to close the second ports;

(6) bleeding off the nitrogen until the tubing pressure is reduced to a predetermined value less than the lower borehole pressure;

(7) effecting the fluid pressure in the lower borehole annulus on the first piston to slide the first piston and open the first ports; and (8) flowing fluids from the formation, through the perforations and first ports, into the tubing string and up to the surface to backsurge the perforations.

30. The method of claim 29 with a perforating gun also suspended on the tubing string and including the steps of:

(1) removing the bar from the tubing string; and (2) lowering another bar through the tubing string to detonate the perforating gun to separate the formation.

* * * * *